US010181245B2

(12) United States Patent
Krula

(10) Patent No.: US 10,181,245 B2
(45) Date of Patent: Jan. 15, 2019

(54) DRYER VENT MONITORING DEVICE

(71) Applicant: Nortek Security & Control LLC, Carlsbad, CA (US)

(72) Inventor: David Alan Krula, San Diego, CA (US)

(73) Assignee: Nortek Security & Control LLC, Carlsbad, CA (US)

( * ) Notice: Subject to any disclaimer, the term of this patent is extended or adjusted under 35 U.S.C. 154(b) by 0 days.

(21) Appl. No.: 15/394,514

(22) Filed: Dec. 29, 2016

(65) Prior Publication Data

US 2018/0190093 A1 Jul. 5, 2018

(51) Int. Cl.

| | |
|---|---|
| ***G08B 19/00*** | (2006.01) |
| ***D06F 58/28*** | (2006.01) |
| ***G08B 21/18*** | (2006.01) |

(52) U.S. Cl.

CPC ..... *G08B 19/00* (2013.01); *D06F 58/28* (2013.01); *G08B 21/182* (2013.01); *D06F 2058/2858* (2013.01)

(58) Field of Classification Search

CPC ..... D06F 58/28; F26B 21/12

See application file for complete search history.

(56) References Cited

U.S. PATENT DOCUMENTS

| | | | |
|---|---|---|---|
| 4,649,654 | A | 3/1987 | Hikino et al. |
| 4,827,627 | A | 5/1989 | Cardoso |
| 6,637,127 | B2 | 10/2003 | Reede et al. |
| 6,648,077 | B2 | 11/2003 | Hoffman |
| 6,655,047 | B2 | 12/2003 | Miller |
| 6,725,570 | B2 | 4/2004 | Confoey et al. |
| 6,973,819 | B2 | 12/2005 | Ruhland et al. |
| 7,055,262 | B2 | 6/2006 | Goldberg et al. |
| 7,213,349 | B1 | 5/2007 | Brunner |
| 7,987,615 | B2 | 8/2011 | Han et al. |
| 8,015,726 | B2 | 9/2011 | Carow et al. |
| 8,256,133 | B2 | 9/2012 | Asciolla et al. |
| 8,256,139 | B2 | 9/2012 | Richards et al. |
| 8,429,833 | B2 | 4/2013 | Harpenau |
| 8,627,581 | B2 | 1/2014 | Brown |

(Continued)

FOREIGN PATENT DOCUMENTS

DE 102011078916 A1 1/2013

*Primary Examiner* — Fabricio R Murillo Garcia

(74) *Attorney, Agent, or Firm* — Schwegman Lundberg & Woessner, P.A.

(57) ABSTRACT

A dryer vent monitor device includes a temperature sensor coupled to a dryer exhaust pipe to measure a temperature inside the dryer exhaust pipe. A differential air pressure sensor is coupled at an input connection between a dryer and the exhaust pipe and at an output connection between the dryer exhaust pipe and an outdoor vent. The differential air pressure sensor measures a differential air pressure between the input connection and the output connection. A transceiver communicates with a monitoring system registered with the dryer vent monitoring device. The dryer vent monitoring device compares both the temperature and the differential air pressure with a preset threshold, determines that at least one of the temperature and the differential air pressure exceed the preset threshold, and generates an alert signal in response to determining that at least one of the temperature and the differential air pressure exceed the preset threshold.

18 Claims, 3 Drawing Sheets

(56) References Cited

U.S. PATENT DOCUMENTS

| | | | | |
|---|---|---|---|---|
| 9,297,493 | B2 | 3/2016 | Bison et al. | |
| 2004/0159008 | A1* | 8/2004 | Harpenau | D06F 58/28 34/595 |
| 2005/0091878 | A1 | 5/2005 | Yang et al. | |
| 2007/0124955 | A1* | 6/2007 | Crnkovich | D06F 58/28 34/402 |
| 2008/0127506 | A1* | 6/2008 | Han | D06F 58/20 34/235 |
| 2008/0231468 | A1 | 9/2008 | Myllymaki | |
| 2009/0038178 | A1 | 2/2009 | Ahn | |
| 2010/0139366 | A1 | 6/2010 | Krausch | |
| 2010/0175898 | A1 | 7/2010 | Steinicke | |
| 2015/0143712 | A1* | 5/2015 | Cunningham | D06F 58/20 34/443 |
| 2015/0322617 | A1* | 11/2015 | Asciolla | F26B 21/12 34/427 |
| 2016/0244907 | A1 | 8/2016 | Villella et al. | |

* cited by examiner

DRYER VENT MONITORING DEVICE

TECHNICAL FIELD

This application relates generally to a monitoring device, and, in a specific example embodiment, a drying vent monitoring device for detecting unsafe operating conditions.

BACKGROUND

Many fires are caused by problems within the clothes dryer exhaust where excess pressure and or temperatures lead to common residential and/or commercial fires. One potential cause for such is a reduced air flow through the dryer due to build-up of lint in the exhaust vent or blockage of the exhaust vent. Without adequate air flow through the dryer, the temperature inside the exhaust vent increases and the likelihood of a fire increases.

BRIEF DESCRIPTION OF THE DRAWINGS

The present embodiments are illustrated by way of example, and not by way of limitation, in the figures of the accompanying drawings.

DETAILED DESCRIPTION

Figure 1:
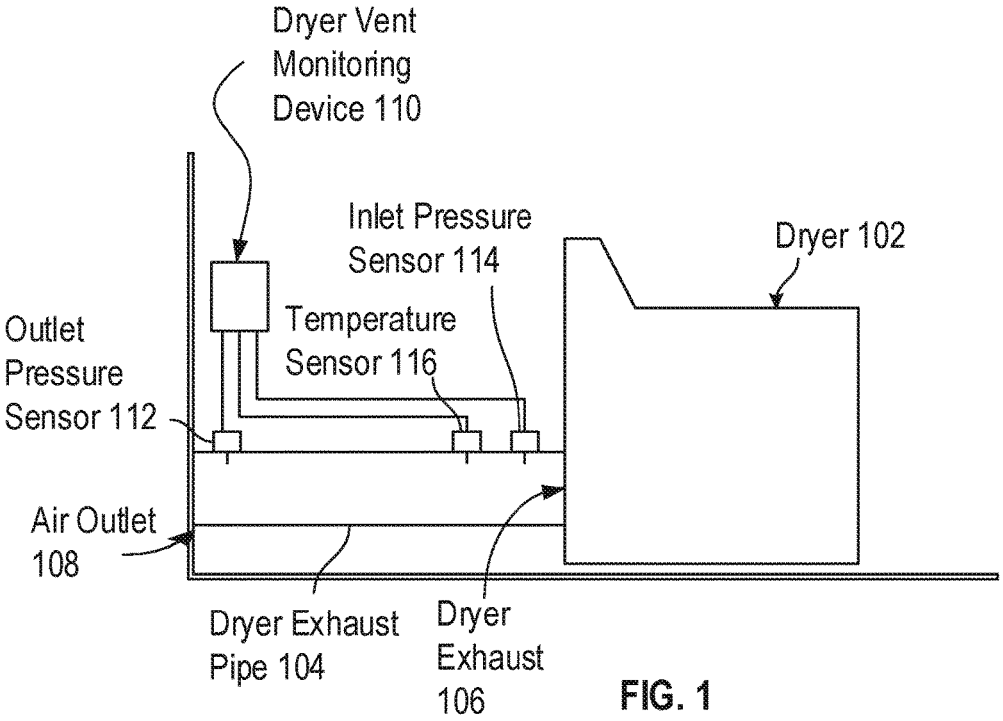
FIG. 1 is a diagram illustrating an example embodiment of a dryer vent monitoring device applied to a cloth dryer in a house.

Although the present disclosure has been described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense.

The present disclosure describes a vent hose assembly with ability to measure a temperature and differential air pressure to sense and monitor any abnormal (excessive) temperature or back pressure within the exhaust path of a residential home or business commercial dryer whether it being an electric or gas heated drier. For example, the vent assembly includes a low profile temperature sensor with integrated pressure differential sensor that could be monitored for any dangerous or abnormal function or condition. The sensors could be installed as part of a fully replaceable heat vent exhaust connection pipe assembly or could be an after-market upgrade kit.

A normally operating clothes dryer vent will exhaust used heated moist air through the exhaust, where the typical exhaust temperatures are in the proximity of 164 degrees Fahrenheit. If a condition of either a clogged or kinked exhaust pipe happens then the dryer's exhaust pressure increases and the exhaust temperatures can increase to a point at which there is a potential for starting a fire from excessive heating of the lint residues within the exhaust path. In the event that a dryer malfunctions, or the temperature shutoff monitor thermostat fails, then the operator can be alerted to intervene to prevent a fire, or can be prompted to perform or call for repairs to eliminate the unsafe condition.

A dual thermal differential pressure sensor is located within dryer's exhaust path located between the dryer and the wall connection that leads to the outside exhaust vent. installation closer to the actual dryer exhaust connection is preferred because it is most effective for sensing unsafe exhaust conditions.

The thermal sensor can be wired or wireless with an option for an external battery replacement without having to take the vent off.

The differential pressure sensor can be wired or wireless which includes a small input sensing element connected to the output side consisting of a non-flammable/non-melting flexible or semi-flexible pipe or hose that runs to the outside vent that senses normal atmospheric pressure. The inlet and outlet pressures are compared to monitor function within the exhaust system. Any excessive differential pressure could indicate: 1) a clogged vent, 2) a kinked exhaust vent, or 3) a vent exhaust door that is stuck closed, or 4) a malfunctioning dryer thermal safety system.

Any of these faults triggers an alarm (wired or wireless) which signals the operator to terminate the drying action, then prompts the operator to get or perform maintenance to: A) fix the kink or B) clean out the excess lint build up C) repair or clean out of the outside exhaust door or D) call for repair of a malfunctioning dryer.

In various embodiments, a dryer vent monitor device includes a temperature sensor coupled to a dryer exhaust pipe to measure a temperature inside the dryer exhaust pipe. A differential air pressure sensor is coupled at an input connection between a dryer and the exhaust pipe and at an output connection between the dryer exhaust pipe and an outdoor vent. The differential air pressure sensor measures a differential air pressure between the input connection and the output connection. A transceiver communicates with a monitoring system registered with the dryer vent monitoring device. The dryer vent monitoring device compares both the temperature and the differential air pressure with a preset threshold, determines that at least one of the temperature and the differential air pressure exceed the preset threshold, and generating an alert signal in response to determining that at least one of the temperature and the differential air pressure exceed the preset threshold.

In one example embodiment, the differential air pressure sensor includes: a first inlet sensor coupled to the input connection, the first inlet sensor configured to measure an input air pressure at the input connection; and a second inlet sensor coupled to the output connection, the second inlet sensor configured to measure an output air pressure at the output connection, the differential air pressure sensor configured to measure the differential air pressure based on a difference between the input air pressure and the output air pressure.

In another example embodiment, the preset threshold includes a maximum temperature and a maximum differential air pressure.

In another example embodiment, the dryer vent monitor device determines that the temperature exceeds the maximum temperature, and generates a temperature alert signal in response to determining that the temperature exceeds the maximum temperature. The temperature alert signal identifies that the temperature is unsafe.

In another example embodiment, the dryer vent monitor device sends, using the transceiver, the temperature alert signal to the monitoring system.

In another example embodiment, the dryer vent monitor device determines that the differential air pressure exceeds the maximum differential pressure, and generates a differential air pressure alert signal in response to determining that the differential air pressure exceeds the maximum differential pressure. The differential air pressure alert signal identifies that the differential air pressure is unsafe.

In another example embodiment, the dryer vent monitor device sends, using the transceiver, the differential air pressure alert signal to the monitoring system.

In another example embodiment, the dryer vent monitor device determines that the temperature exceeds the maximum temperature, determines that the differential air pressure exceeds the maximum differential pressure, generates a temperature and differential air pressure alert signal in response to determining that the temperature exceeds the maximum temperature, the temperature and differential air pressure alert signal identifying that both the temperature and the differential air pressure are unsafe.

In another example embodiment, the dryer vent monitor device sends, using the transceiver, the temperature and differential air pressure alert signal to the monitoring system.

In another example embodiment, the dryer vent monitor device includes an audio or visual indicator configured to generate an audio or visual signal in response to the alert signal.

FIG. 1 is a diagram illustrating an example embodiment of a dryer vent monitoring device applied to a clothes dryer in a house. A dryer exhaust pipe 104 connects a dryer exhaust 106 of a clothes dryer 102 to an air outlet 108. A temperature sensor 116 is connected to the dryer exhaust pipe 104 to measure the temperature inside the dryer exhaust pipe 104. In one example, the temperature sensor 116 includes a probe that is inserted into the dryer exhaust pipe 104 close to the dryer exhaust 106. In another example, the temperature sensor 116 is mounted to the outside of the dryer exhaust pipe 104 to measure the surface temperature of the dryer exhaust pipe 104.

An inlet pressure sensor 114 is connected to the dryer exhaust pipe 104 at the dryer exhaust 106 and measures the air pressure inside the dryer exhaust pipe 104 at or around the dryer exhaust 106. An outlet pressure sensor 112 is connected to the dryer exhaust pipe 104 at the air outlet 108 and measures the air pressure inside the dryer exhaust pipe 104 at or around the dryer exhaust pipe 104.

A dryer vent monitoring device 110 is connected to the temperature sensor 116, the inlet pressure sensor 114, and the outlet pressure sensor 112. The dryer vent monitoring device 110 calculates the differential air pressure detected between the inlet pressure sensor 114 and the outlet pressure sensor 112. For example, the higher the differential air pressure, the more likely the dryer exhaust pipe 104 is clogged or includes lint build up. The dryer vent monitoring device 110 uses the temperature measurement and the differential air pressure measurement to determine whether the dryer exhaust pipe 104 requires immediate attention and is at risk of tire. An example of the dryer vent monitoring device 110 is described below.

Figure 2:
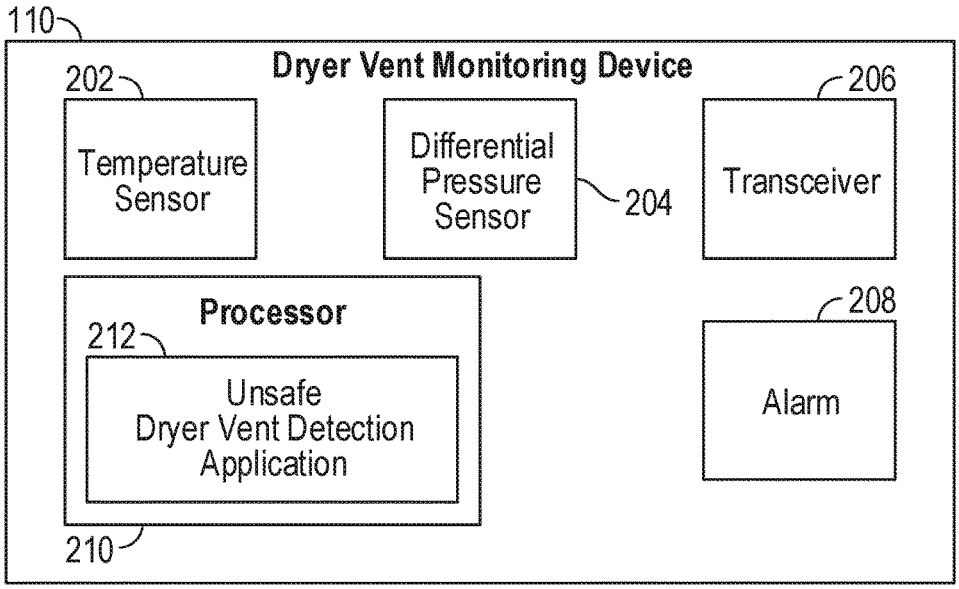
FIG. 2 is a block diagram illustrating an example embodiment of a dryer vent monitoring device.

FIG. 2 is a block diagram illustrating an example embodiment of a dryer vent monitoring device 110. The dryer vent monitoring device 110 includes a temperature sensor 202, a differential pressure sensor 204, a transceiver 206, an audio/visual alarm 208, and a processor 210. The temperature sensor 202 measures the temperature of the dryer exhaust pipe 104. In one example, the temperature sensor 202 is placed at a location inside the dryer exhaust pipe 104 near the dryer exhaust 106. In another example, the temperature sensor 202 includes several thermal sensors placed at regular intervals along the length of the dryer exhaust pipe 104 to take sample measurements of the temperature of the dryer exhaust pipe 104. The sampled temperature measurements can be analyzed to identify a location along the dryer exhaust pipe 104 where the temperature differential exceeds a temperature threshold. For example, the sampled temperatures indicate a peak temperature up through till the point of the clog. The peak temperature may be the result of a buildup located around the middle of the dryer exhaust pipe 104. If multiple points of temperature monitoring are implemented, the hottest area will still be at the immediate location of the exhaust and as the farther away the clog is the metal exhaust vent pipe will be dissipating some of the heat so a clog further down the length of the exhaust pipe may have a signature of a higher differential temperature change from hot to less hot.

The differential pressure sensor 204 measures the differential pressure between the air pressure at the air outlet 108 and the air pressure at the dryer exhaust 106. In one example embodiment, the differential pressure sensor 204 computes the differential air pressure from measurements performed by the inlet pressure sensor 114 and the outlet pressure sensor 112.

The transceiver 206 includes a wired or wireless communication means (e.g., WiFi, Bluetooth, Zigbee, UHF) to communicate with another device monitoring system, mobile device). The transceiver 206 communicates the temperature and differential air pressure measurements.

The processor 210 includes an unsafe dryer vent detection application 212 to determine whether the dryer exhaust pipe 104 has a restricted air flow. In one example embodiment, the unsafe dryer vent detection application 212 compares the temperature of the dryer exhaust pipe 104 with a preset temperature threshold. If the measured temperature of the dryer exhaust pipe 104 exceeds a preset temperature threshold, the unsafe dryer vent detection application 212 generates an alert signal to the transceiver 206 and the audio/visual alarm 208 to notify the homeowner of the danger and risk of fire. In another example embodiment, the unsafe dryer vent detection application 212 compares the differential air pressure of the dryer exhaust pipe 104 with a preset differential air pressure threshold. If the measured differential air pressure of the dryer exhaust pipe 104 exceeds a preset differential air pressure threshold, the unsafe dryer vent detection application 212 generates an alert signal to the transceiver 206 and the audio/visual alarm 208 to notify the operator of the danger and risk of fire. In another example embodiment, if both the measured temperature of the dryer exhaust pipe 104 exceeds the preset temperature threshold and the measured differential air pressure of the dryer exhaust pipe 104 exceeds the preset differential air pressure threshold, the unsafe dryer vent detection application 212 generates an alert signal to the transceiver 206 and the audio/visual alarm 208 to notify the operator of the danger and risk of fire.

Figure 3:
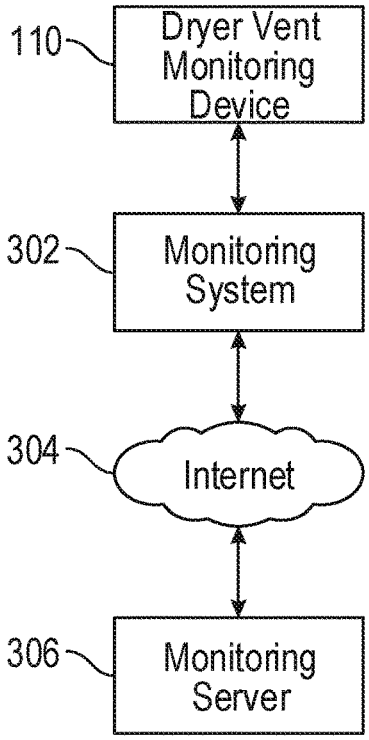
FIG. 3 is a block diagram illustrating an example embodiment of a network environment for operating a dryer vent monitoring device.

FIG. 3 is a block diagram illustrating an example embodiment of a network environment for operating a dryer vent monitoring device 110. The dryer vent monitoring device 110 transmits an alarm notification or message via the transceiver 206 (via wired or wireless means) to a monitoring system 302 (e.g., home security console registered with the dryer vent monitoring device 110). The monitoring system 302, in turn, communicates with the monitoring server 306 (e.g., a central monitor station) via a computer network (e.g., Internet 304). The monitoring server 306 records the alarm notification and may alert the operator or designated third-parties of the risk of fire.

Figure 4:
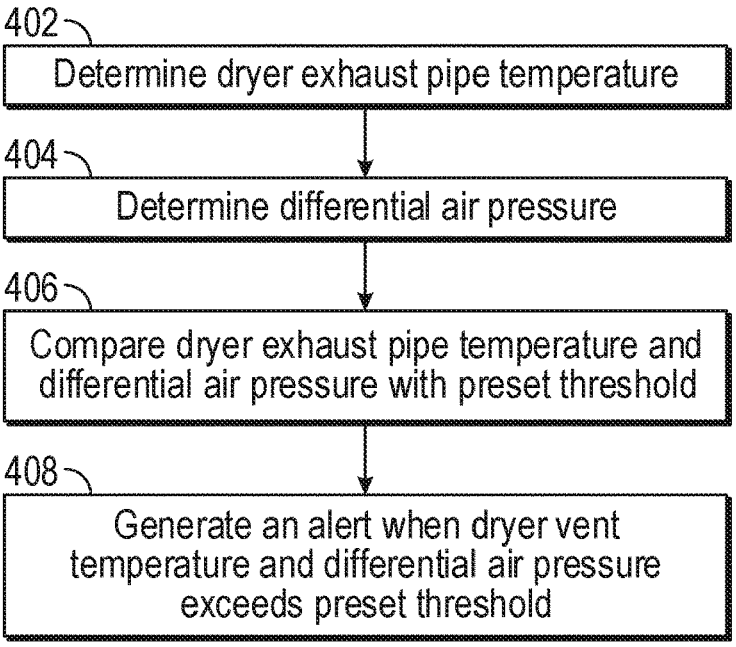
FIG. 4 is a flow diagram illustrating another example embodiment of a method of operating a dryer vent monitoring device.

FIG. 4 is a flow diagram illustrating another example embodiment of a method of for operating a dryer vent monitoring device 110. At operation 402, the dryer vent monitoring device 110 determines the temperature of the dryer exhaust pipe 104 using the temperature sensor 116 coupled to the dryer exhaust pipe 104. At operation 404, the dryer vent monitoring device 110 determines the differential air pressure between the air pressure at the dryer exhaust 106 and the air outlet 108. At operation 406, the dryer vent monitoring device 110 compares the measured temperature of the dryer exhaust pipe 104 and the measured differential air pressure with a preset threshold (or limit). At operation 408, the dryer vent monitoring device 110 generates an alert when a combination of the measured temperature of the dryer exhaust pipe 104 and the measured differential air pressure exceeds the preset threshold. In another example embodiment, the dryer vent monitoring device 110 communicates with the dryer 102 to disable the dryer 102 from operating (e.g., dryer 102 stops in response to the alert). In another example embodiment, the dryer vent monitoring device 110 prevents the dryer 102 from operating by switching off a power outlet connected to the dryer 102.

In another example embodiment, the presently described method can also generate histogram trends of both temperatures and pressures via Monitoring System 302 or Monitoring Server 306, to identify and create an alert as to when preventive maintenance is required all prior to an alert signal stating that the operating conditions are unsafe.

Modules, Components and Logic

Certain embodiments are described herein as including logic or a number of components, modules, or mechanisms. Modules may constitute either software modules (e.g., code embodied on a machine-readable medium or in a transmission signal) or hardware modules. A hardware module is a tangible unit capable of performing certain operations and may be configured or arranged in a certain manner. In example embodiments, one or more computer systems (e.g., a standalone, client, or server computer system) or one or more hardware modules of a computer system (e.g., a processor 210 or a group of processors 210) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor 210 or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired) or temporarily configured (e.g., programmed) to operate in a certain manner and/or to perform certain operations described herein. Considering embodiments in which hardware modules are temporarily configured (e.g., programmed), each of the hardware modules need not be configured or instantiated at any one instance in time. For example, where the hardware modules comprise a general-purpose processor 210 configured using software, the general-purpose processor 210 may be configured as respective different hardware modules at different times. Software may accordingly configure a processor 210, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses that connect the hardware modules). In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices and can operate on a resource (e.g., a collection of information).

The various operations of example methods described herein may be performed, at least partially, by one or more processors 210 that are temporarily configured (e.g., by software) or permanently configured to perform the relevant operations. Whether temporarily or permanently configured, such processors 210 may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors 210 or processor-implemented modules. The performance of certain of the operations may be distributed among the one or more processors 210, not only residing within a single machine, but deployed across a number of machines. In some example embodiments, the processor or processors 210 may be located in a single location (e.g., within a home environment, an office environment, or a server farm), while in other embodiments the processors 210 may be distributed across a number of locations.

The one or more processors 210 may also operate to support performance of the relevant operations in a "cloud computing" environment or as a "software as a service" (SaaS). For example, at least some of the operations may be performed by a group of computers (as examples of machines including processors 210), these operations being accessible via the communication network 304 and via one or more appropriate interfaces (e.g., application programming interfaces (APIs)).

Electronic Apparatus and System

Example embodiments may be implemented in digital electronic circuitry, in computer hardware, firmware, or software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor 210, a computer, or multiple computers.

A computer program can be written in any form of programming language, including compiled or interpreted languages, and it can be deployed in any form, including as a standalone program or as a module, subroutine, or other unit suitable for use in a computing environment. A computer program can be deployed to be executed on one computer or on multiple computers at one site or distributed across multiple sites and interconnected by a communication network 304.

In example embodiments, operations may be performed by one or more programmable processors 210 executing a computer program to perform functions by operating on input data and generating output. Method operations can also be performed by, and apparatus of example embodiments may be implemented as, special purpose logic circuitry (e.g., a FPGA or an ASIC).

A computing system can include clients and servers. A client and server are generally remote from each other and typically interact through a communication network 304. The relationship of client and server arises by virtue of computer programs running on the respective computers and having a client-server relationship to each other. In embodiments deploying a programmable computing system, it will be appreciated that both hardware and software architectures merit consideration. Specifically, it will be appreciated that the choice of whether to implement certain functionality in permanently configured hardware (e.g., an ASIC), in temporarily configured hardware (e.g., a combination of software and a programmable processor 210), or in a combination of permanently and temporarily configured hardware may be a design choice. Below are set out hardware (e.g., machine) and software architectures that may be deployed, in various example embodiments.

Example Machine Architecture

Figure 5:
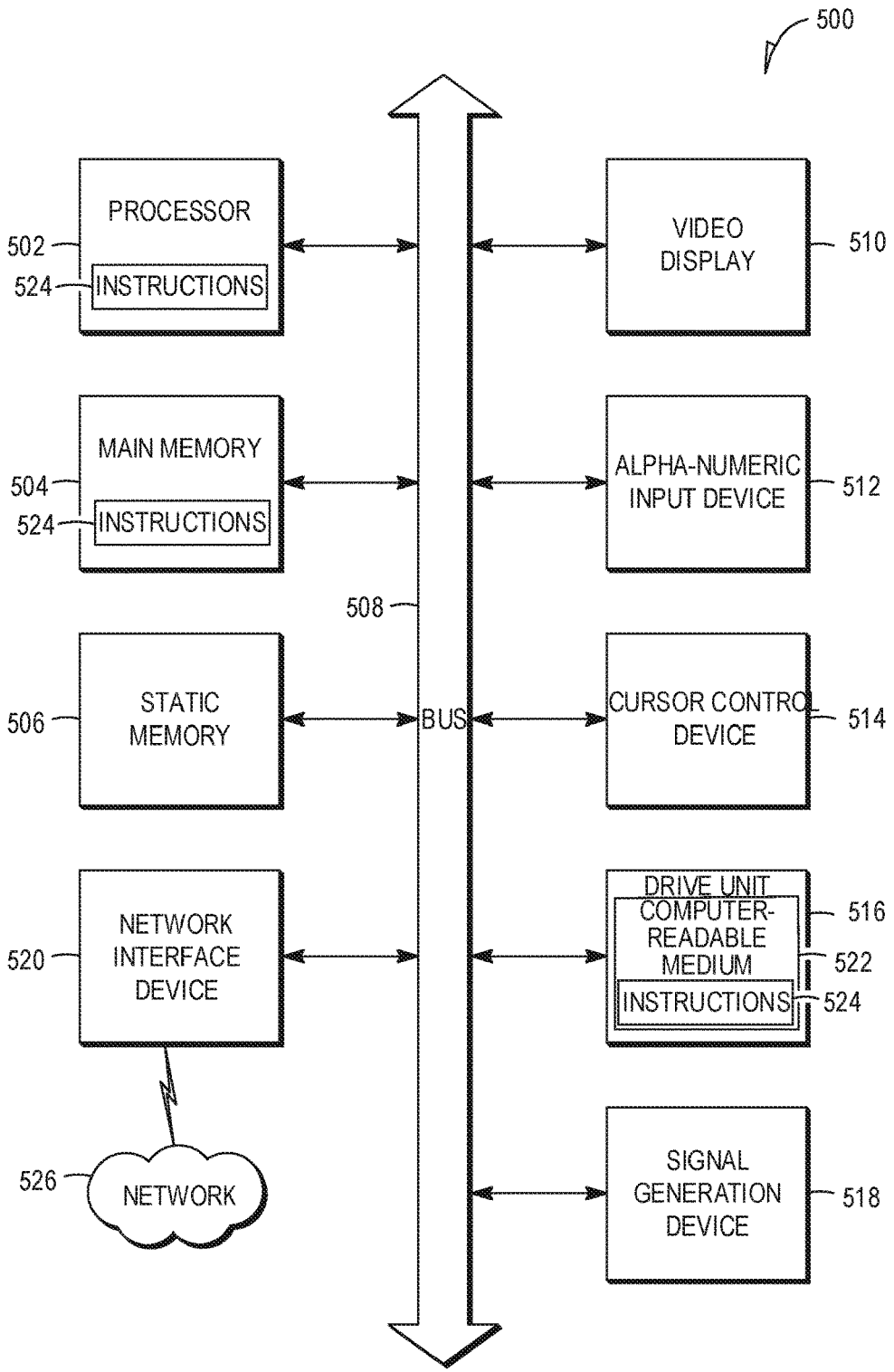
FIG. 5 shows a diagrammatic representation of a machine in the example form of a computer system within which a set of instructions may be executed to cause the machine to perform any one or more of the methodologies discussed herein.

FIG. 5 is a block diagram of a machine in the example form of a computer system 500 within which instructions 524 for causing the machine to perform any one or more of the methodologies discussed herein may be executed. In alternative embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (SIB), a personal digital assistant (PDA), a cellular telephone, a web appliance, a network router, a network switch, a network bridge, or any machine capable of executing the instructions 524 (sequential or otherwise) that specify actions to be taken by that machine. Further, while only a single machine is illustrated, the term "machine" shall also be taken to include any collection of machines that individually or jointly execute a set (or multiple sets) of instructions 524 to perform any one or more of the methodologies discussed herein.

The example computer system 500 includes a processor 502 (e.g., a central processing unit (CPU), a graphics processing unit (GPU), or both), a main memory 504, and a static memory 506, which communicate with each other via a bus 508. The computer system 500 may further include a video display unit 510 (e.g., a liquid crystal display (LCD) or a cathode ray tube (CRI)). The computer system 500 also includes an alphanumeric input device 512 (e.g., a keyboard), a user interface (UI) navigation (or cursor control) device 514 (e.g., a mouse), a disk drive unit 516, a signal generation device 518 (e.g., a speaker), and a network interface device 520.

Machine-Readable Medium

The disk drive unit 516 includes a computer-readable medium 522 on which is stored one or more sets of data structures and instructions 524 (e.g., software) embodying or utilized by any one or more of the methodologies or functions described herein. The instructions 524 may also reside, completely or at least partially, within the main memory 504 and/or within the processor 502 during execution thereof by the computer system 500, the main memory 504 and the processor 502 also constituting computer-readable media 522. The instructions 524 may also reside, completely or at least partially, within the static memory 506.

While the computer-readable medium 522 is shown, in an example embodiment, to be a single medium, the term "machine-readable medium" may include a single medium or multiple media (e.g., a centralized or distributed database, and/or associated caches and servers) that store the one or more instructions 524 or data structures. The term "computer-readable medium" shall also be taken to include any tangible medium that is capable of storing, encoding, or carrying the instructions 524 for execution by the machine and that cause the machine to perform any one or more of the methodologies of the present embodiments, or that is capable of storing, encoding, or carrying data structures utilized by or associated with such instructions 524. The term "computer-readable medium" shall accordingly be taken to include, but not be limited to, solid-state memories, and optical and magnetic media. Specific examples of computer-readable media 522 include non-volatile memory including, by way of example, semiconductor memory devices (e.g., erasable programmable read-only memory (EPROM), electrically erasable programmable read-only memory (EEPROM), and flash memory devices); magnetic disks such as internal hard disks and removable disks; magneto-optical disks; and compact disc-read-only memory (CD-ROM) and digital versatile disc (or digital video disc) read-only memory (DVD-ROM) disks.

Transmission Medium

The instructions 524 may further be transmitted or received over a communication network 526 using a transmission medium. The instructions 524 may be transmitted using the network interface device 520 and any one of a number of well-known transfer protocols (e.g., hypertext transfer protocol (HTTP)). Examples of communication networks 526 include a local-area network (LAN), a wide-area network (WAN), the Internet 306, mobile telephone networks, plain old telephone service (POTS) networks, and wireless data networks (e.g., Wi-Fi and WiMAX networks). The term "transmission medium" shall be taken to include any intangible medium capable of storing, encoding, or carrying the instructions 524 for execution by the machine, and includes digital or analog communications signals or other intangible media to facilitate communication of such software.

Although an embodiment has been described with reference to specific example embodiments, it will be evident that various modifications and changes may be made to these embodiments without departing from the scope of the present disclosure. Accordingly, the specification and drawings are to be regarded in an illustrative rather than a restrictive sense. The accompanying drawings that form a part hereof show, by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The following enumerated embodiments describe various example embodiments of a dryer vent monitoring device 110 discussed herein.

A first embodiment provides a dryer vent monitoring device 110 comprising:

a temperature sensor 202 configured to be coupled to a dryer exhaust pipe 104 and to measure a temperature inside the dryer exhaust pipe 104;

a differential air pressure sensor 204 configured to be coupled at an input connection between a dryer 102 and the exhaust pipe 104 and at an output connection between the dryer exhaust pipe 104 and an outdoor vent, and configured to measure a differential air pressure between the input connection and the output connection;

a transceiver 206 configured to communicate with a monitoring system 302 registered with the dryer vent monitoring device 110; and a processor 210 configured to perform operations comprising:

determining the temperature inside the dryer exhaust pipe 104;

determining the differential air pressure between the input connection and the output connection;

comparing both the temperature and the differential air pressure with a preset threshold;

determining that at least one of the temperature and the differential air pressure exceed the preset threshold; and generating an alert signal in response to determining that at least one of the temperature and the differential air pressure exceed the preset threshold.

A second embodiment provides a dryer vent monitoring device 110 according to the first embodiment, wherein the differential pressure sensor 204 includes:

a first inlet sensor coupled to the input connection, the first inlet sensor configured to measure an input air pressure at the input connection; and a second inlet sensor coupled to the output connection, the second inlet sensor configured to measure an output air pressure at the output connection, the differential air pressure sensor configured to measure the differential air pressure based on a difference between the input air pressure and the output air pressure.

A third embodiment provides a dryer vent monitoring device 110 according to the first embodiment, wherein the preset threshold includes a maximum temperature and a maximum differential air pressure.

A fourth embodiment provides a dryer vent monitoring device 110 according to the third embodiment, wherein the operations further comprise:

determining that the temperature exceeds the maximum temperature; and generating a temperature alert signal in response to determining that the temperature exceeds the maximum temperature, the temperature alert signal identifying that the temperature is unsafe.

A fifth embodiment provides a dryer vent monitoring device 110 according to the fourth embodiment, wherein the operations further comprise:

sending, using the transceiver 206, the temperature alert signal to the monitoring system 302.

A sixth embodiment provides a dryer vent monitoring device 110 according to the third embodiment, wherein the operations further comprise:

determining that the differential air pressure exceeds the maximum differential pressure; and generating a differential air pressure alert signal in response to determining that the differential air pressure exceeds the maximum differential pressure, the differential air pressure alert signal identifying that the differential air pressure is unsafe.

A seventh embodiment provides a dryer vent monitoring device 110 according to the sixth embodiment, wherein the operations further comprise:

sending, using the transceiver 206, the differential air pressure alert signal to the monitoring system 302.

An eighth embodiment provides a dryer vent monitoring device 110 according to the third embodiment, wherein the operations further comprise:

determining that the temperature exceeds the maximum temperature;

determining that the differential air pressure exceeds the maximum differential pressure; and generating a temperature and differential air pressure alert signal in response to determining that the temperature exceeds the maximum temperature, the temperature and differential air pressure alert signal identifying that both the temperature and the differential air pressure are unsafe.

A ninth embodiment provides a dryer vent monitoring device 110 according to the eighth embodiment, wherein the operations further comprise:

sending, using the transceiver 206, the temperature and differential air pressure alert signal to the monitoring system 302.

A tenth embodiment provides a dryer vent monitoring device 110 according to the first embodiment, further comprising:

an audio or visual indicator configured to generate an audio or visual signal in response to the alert signal.

What is claimed is:

1. A dryer vent monitor device comprising:

a temperature sensor configured to be coupled to a dryer exhaust pipe and to measure a temperature inside the dryer exhaust pipe, the dryer exhaust pipe having a first end and a second end, the first end coupled to a dryer exhaust of a dryer, the second end coupled to an air outlet;

a differential air pressure sensor configured to measure a differential air pressure between the first end of the dryer exhaust pipe and the second end of the dryer exhaust pipe;

a transceiver configured to communicate with a monitoring system registered with the dryer vent monitoring device; and a processor configured to compare a combination of the temperature and the differential air pressure with a preset threshold, to determine that the combination of the temperature and the differential air pressure exceeds the preset threshold, and to generate an alert signal to the transceiver in response to determining that the combination of the temperature and the differential air pressure exceeds the preset threshold, wherein the differential air pressure sensor includes:

a first pressure sensor coupled to the first end of the dryer exhaust pipe, the first pressure sensor configured to measure an input air pressure, from the dryer exhaust, at the first end of the dryer exhaust pipe; and a second pressure sensor coupled to the second end of the dryer exhaust pipe the second pressure sensor configured to measure an output air pressure, from the dryer exhaust pipe, at the second end of the dryer exhaust pipe, the differential air pressure sensor being configured to measure the differential air pressure based on a difference between the input air pressure and the output air pressure.

2. The dryer vent monitor device of claim 1, wherein the preset threshold includes a maximum temperature and a maximum differential air pressure.

3. The dryer vent monitor device of claim 2, wherein the processor is configured to determine that the temperature exceeds the maximum temperature, to generate a temperature alert signal in response to determining that the temperature exceeds the maximum temperature, the temperature alert signal identifying that the temperature is unsafe.

4. The dryer vent monitor device of claim 3, wherein the transceiver is configured to send the temperature alert signal to the monitoring system.

5. The dryer vent monitor device of claim 2, wherein the processor is configured to determine that the differential air pressure exceeds the maximum differential air pressure, to generate a differential air pressure alert signal in response to determining that the differential air pressure exceeds the maximum differential pressure, the differential air pressure alert signal identifying that the differential air pressure is unsafe.

6. The dryer vent monitor device of claim 5, wherein the transceiver is configured to send the differential air pressure alert signal to the monitoring system.

7. The dryer vent monitor device of claim 2, wherein the processor is configured to determine that the temperature exceeds the maximum temperature, to determine that the differential air pressure exceeds the maximum differential air pressure, to generate a temperature and differential air pressure alert signal in response to determining that the temperature exceeds the maximum temperature and that the differential air pressure exceeds the maximum differential air pressure, the temperature and differential air pressure alert signal identifying that both the temperature and the differential air pressure are unsafe.

8. The dryer vent monitor device of claim 7, wherein the transceiver is configured to send temperature and differential air pressure alert signal to the monitoring system.

9. The dryer vent monitor device of claim 1, further comprising:

an audio or visual indicator configured to generate an audio or visual signal in response to the alert signal.

10. A method comprising:

measuring a temperature inside a dryer exhaust pipe with a temperature sensor configured to be coupled to the dryer exhaust pipe, the dryer exhaust pipe having a first end and a second end, the first end coupled to a dryer exhaust of a dryer, the second end coupled to an air outlet;

measuring, with a differential air pressure sensor, a differential air pressure between the first end of the dryer exhaust pipe and the second end of the dryer exhaust pipe;

comparing a combination of the temperature and the differential air pressure with a preset threshold;

determining that the combination of the temperature and the differential air pressure exceed the preset threshold; and generating an alert signal in response to determining that the combination of the temperature and the differential air pressure exceed the preset threshold, wherein the differential air pressure sensor includes:

a first pressure sensor coupled to the first end of the dryer exhaust pipe, the first pressure sensor configured to measure an input air pressure, from the dryer exhaust at the first end of the dryer exhaust pipe; and a second pressure sensor coupled to the second end of the dryer exhaust pipe, the second pressure sensor configured to measure an output air pressure, from the dryer exhaust pipe, at the second end of the dryer exhaust pipe, the differential air pressure sensor being configured to measure the differential air pressure based on a difference between the input air pressure and the output air pressure.

11. The method of claim 10, wherein the preset threshold includes a maximum temperature and a maximum differential air pressure.

12. The method of claim 11, further comprising:

determining that the temperature exceeds the maximum temperature; and generating a temperature alert signal in response to determining that the temperature exceeds the maximum temperature, the temperature alert signal identifying that the temperature is unsafe.

13. The method of claim 12, further comprising:

sending, using a transceiver, the temperature alert signal to a monitoring system registered with the dryer vent monitor device.

14. The method of claim 11, further comprising:

determining that the differential air pressure exceeds the maximum differential pressure; and generating a differential air pressure alert signal in response to determining that the differential air pressure exceeds the maximum differential pressure, the differential air pressure alert signal identifying that the differential air pressure is unsafe.

15. The method of claim 14, further comprising:

sending, using a transceiver, the differential air pressure alert signal to the monitoring system registered with the dryer vent monitor device.

16. The method of claim 11, further comprising:

determining that the temperature exceeds the maximum temperature;

determining that the differential air pressure exceeds the maximum differential pressure; and generating a temperature and differential air pressure alert signal in response to determining that the temperature exceeds the maximum temperature and that the differential air pressure exceeds the maximum differential pressure, the temperature and differential air pressure alert signal identifying that both the temperature and the differential air pressure are unsafe.

17. The method of claim 16, further comprising:

sending, using a transceiver, the temperature and differential air pressure alert signal to the monitoring system registered with the dryer vent monitor device.

18. A non-transitory computer-readable storage medium storing a set of instructions that, when executed by a processor, cause the processor to perform operations comprising:

measuring a temperature inside a dryer exhaust pipe with a temperature sensor configured to be coupled to the dryer exhaust pipe, the dryer exhaust pipe having a first end and a second end, the first end coupled to a dryer exhaust of a dryer, the second end coupled to an air outlet;

measuring, with a differential air pressure sensor, a differential air pressure between the first end of the dryer exhaust pipe and the second end of the dryer exhaust pipe comparing a combination of the temperature and the differential air pressure with a preset threshold;

determining that the combination of the temperature and the differential air pressure exceed the preset threshold; and generating an alert signal in response to determining that the combination of the temperature and the differential air pressure exceed the preset threshold, wherein the differential air pressure sensor includes:

a first pressure sensor coupled to the first end of the dryer exhaust pipe, the first pressure sensor configured to measure an input air pressure, from the dryer exhaust, at the first end of the dryer exhaust pipe; and a second pressure sensor coupled to the second end of the dryer exhaust pipe, the second pressure sensor configured to measure an output air pressure, from the dryer exhaust pipe, at the second end of the dryer exhaust pipe, the differential air pressure sensor being configured to measure the differential air pressure based on a difference between the input air pressure and the output air pressure.

* * * * *